US006132232A

United States Patent [19]

Okada

[11] Patent Number: 6,132,232

[45] Date of Patent: Oct. 17, 2000

[54] CONNECTOR LOCKING CONSTRUCTION FOR A CONNECTOR RECEPTACLE OF AN AUTOMOTIVE ELECTRICAL CONNECTION BOX

[75] Inventor: Koichi Okada, Yokkaichi, Japan

[73] Assignee: Sumitomo Wiring Systems, Ltd., Japan

[21] Appl. No.: 09/105,129

[22] Filed: Jun. 24, 1998

[30] Foreign Application Priority Data

Jun. 24, 1997 [JP] Japan ..... 9-167204

[51] Int. Cl.[7] ..... H01R 13/62

[52] U.S. Cl. ..... 439/357

[58] Field of Search ..... 439/350–354, 439/355–357, 34, 76

[56] References Cited

U.S. PATENT DOCUMENTS

| | | | |
|---|---|---|---|
| 4,909,745 | 3/1990 | Hayashi | 439/76 |
| 5,000,693 | 3/1991 | Hatagishi et al. | 439/248 |
| 5,403,193 | 4/1995 | Ito et al. | 439/34 |

FOREIGN PATENT DOCUMENTS 08223739 of 1996 Japan .

2529465 of 1996 Japan .

*Primary Examiner*—Neil Abrams
*Assistant Examiner*—Eugene G. Byrd
*Attorney, Agent, or Firm*—Anthony J. Casella; Gerald E. Hespos

[57] ABSTRACT

A locking construction is provided to readily fix a connector receptacle of a junction box and a connector by inertial locking. The connector receptacle includes upper and lower casings 12, 11 that are made of polypropylene added with glass and talc. A connector receptacle 14 projects from the upper casing 12 and a connector 16 connected with an end of a wire is fitted into the connector receptacle 14 to lockingly fix the connector and the receptacle. A lock claw 20 having a slanted surface and a horizontal surface located below the slanted surface projects from the upper end of an inner surface of the connector receptacle. A locking portion 22 having a locking beam 22*c* having upper and lower surfaces which are horizontal surfaces 22*e*, 22*f* is provided on an outer surface of the connector 16 to be fitted into the receptacle 14 so that the connector 16 and the receptacle 14 are fixed by inertial locking. Further, a side wall 15*a* of the receptacle 14 where the lock claw 20 projects is made thinner and longer than the other side walls 15*b*.

7 Claims, 3 Drawing Sheets

CONNECTOR LOCKING CONSTRUCTION FOR A CONNECTOR RECEPTACLE OF AN AUTOMOTIVE ELECTRICAL CONNECTION BOX

BACKGROUND OF THE INVENTION

1. Field of the Invention.

The present invention relates to a connector locking construction for or provided in a connector receptacle of an automotive electrical connection box and is particularly designed to improve a locking construction for fitting a connector at the end of a wiring harness into a connector receptacle of a casing made of a rigid resin such as a junction box to lock the connector and the connector receptacle.

2. Description of the Prior Art.

A prior art automotive electrical connection box, such as the junction box as shown FIGS. 4A and 4B, is constructed such that busbars 3 and insulating plates 4' are alternately placed one over another in a casing comprised of upper and lower casings 1 and 2. Tabs are formed by bending the busbars 3 to project into a receptacle 4 which is formed on the outer surface of the upper casing 1 and/or the lower casing 2 for the connection of a connector. A connector 5 connected at an end of a wiring harness W/H is fitted into the receptacle 4 of this prior art electrical connection box, and is fixed by engaging a locking portion 6 formed on the connector 5 with a lock claw 7 projecting from the inner surface of the receptacle 4.

To ensure required strength and rigidity, the upper and lower casings 1, 2 of the junction box generally are made of polypropylene added with glass and talc (PPTG). The PPTG has a disadvantage of higher brittleness as compared with polybutylene (PBT) which is used to form the connector 5 as can be seen from the following table:

| | Unit | PPGT | PBT |
|---|---|---|---|
| Tensile Elongation | % | 2 | 15 |
| Izod Impact Strength | kg cm/cm | 5.0 | 3.0 |

Thus, if a load is concentrated on the lock claw 7 of the receptacle 4, the lock claw 7 is likely to be cracked. Further, since the lock claw 7 of the receptacle 4 is not easily deformable, the locking operation is very difficult.

In view of the above, at the lock portions of the receptacle 4 and the connector 5, the lock claw 7 and the locking portion 6 are formed with slanted surfaces 7*a*, 6*a* on the outer surfaces of the projecting portions thereof and horizontal locking surfaces 7*b*, 6*b* are formed adjacent the slanted surfaces 7*a*, 6*a*, respectively, as shown in FIG. 4(B). The receptacle 4 and the connector 5 are locked by bringing the locking surfaces 7*b*, 6*b* into contact with each other after the slanted surfaces 7*a*, 6*a* slide in contact with each other.

However, with the above locking construction, the locking surfaces 7*b*, 6*b* are engaged after the slanted surfaces 7*a*, 6*a* are slid in contact with each other, an operator cannot easily confirm the completion of the locking operation and a locking force is weak.

In view of the above problems, an object of the present invention is to lock a receptacle and a connector in such a manner as to allow an operator to easily confirm the completion of a locking operation and to prevent damage to a lock claw of the receptacle having a higher brittleness when the connector is fitted into the receptacle of a casing e.g. made of PPGT.

SUMMARY OF THE INVENTION

According to the invention, there is provided a connector locking construction provided in a connector receptacle of an electrical connection box to be mounted preferably on an automotive vehicle, in which a housing of the electrical connection box is made of a material having a brittleness higher than that of polybutylene, and preferably made of polypropylene added with glass and talc. At least one connector receptacle projects from the housing. A connector that is connected or connectable with an end of at least one wire is fitted or fittable into the receptacle and can be fixed lockingly with the connector receptacle. At least one lock claw projects from an end of an inner surface of the connector receptacle, and at least one corresponding locking portion having a locking beam with substantially parallel upper and lower surfaces is provided on an outer surface of the connector to be fitted into the receptacle. Thus the connector and the receptacle are fixed by inertial locking. A thickness. of a side wall of the receptacle where the lock claw projects is made smaller than that of the other side walls and a length of a side wall of the receptacle where the lock claw projects is made larger than that of a corresponding side wall according to prior art. The length of the side wall preferably is substantially equal to or greater than 7 mm.

According to a preferred embodiment, the at least one lock claw has a slanted surface that is slanted to the direction of mating of the connector with the receptacle and a locking surface located below or behind the slanted surface and orthogonal to the direction of mating of the connector with the receptacle.

Most preferably, the upper and lower surfaces are substantially horizontal surfaces.

According to a further preferred embodiment, there is provided a locking construction for a connector receptacle of an electrical connection box to be mounted on an automotive vehicle, in which upper and lower casings of the electrical connection box are made of polypropylene added with glass and talc. A connector receptacle projects from the upper and/or lower casings, and a connector connected with an end of a wire is fitted into and lockingly fixed with the connector receptacle. A lock claw projects from an end of an inner surface of a side wall of the connector receptacle. The side wall of the receptacle where the lock claw projects is made thinner and longer than the other side walls of the connector receptacle and/or thinner and longer than side walls according to prior art connector receptacles. The lock claw has a slanted surface that may be aligned at an acute angle to a direction of insertion. The lock claw also has a locking surface that intersects the slanted surface and that may be perpendicular to the direction of insertion.

A locking portion is provided on an outer surface of the connector to be fitted into the receptacle. The locking portion has a locking beam with a pair of oppositely facing surfaces that may be perpendicular to the direction of mating.

The connector and the receptacle are fixed by inertial locking. With the above inertial locking construction, the slanted surface of the lock claw engages the leading surface of the locking beam that is perpendicular to the direction of mating. This engagement causes the wall of the receptacle from which the lock claw projects to deform outwardly. The wall remains deformed until the trailing surface of the locking beam that is perpendicular to the direction of mating aligns with the locking surface of the lock claw. The wall from which the lock claw projects is restored at once to its original shape when the locking surface of the lock claw is engaged with the trailing surface of the locking beam. Accordingly, a locking operation can be performed which allows an operator to easily confirm the completion thereof can be performed.

Although the above inertial locking construction allows the operator to easily confirm the completion of the locking operation, the lock claw wall needs to be deformed. In view of this, the lock claw wall is made easily deformable by thinning and elongating the side wall of the receptacle where the lock claw is provided. Accordingly, a load is not concentrated on the leading end of the lock claw, thereby preventing it from being cracked.

These and other objects, features and advantages of the present invention will become more apparent upon a reading of the following detailed description and accompanying drawings.

DETAILED DESCRIPTION OF THE PREFERRED EMBODIMENT

Figure 1A:
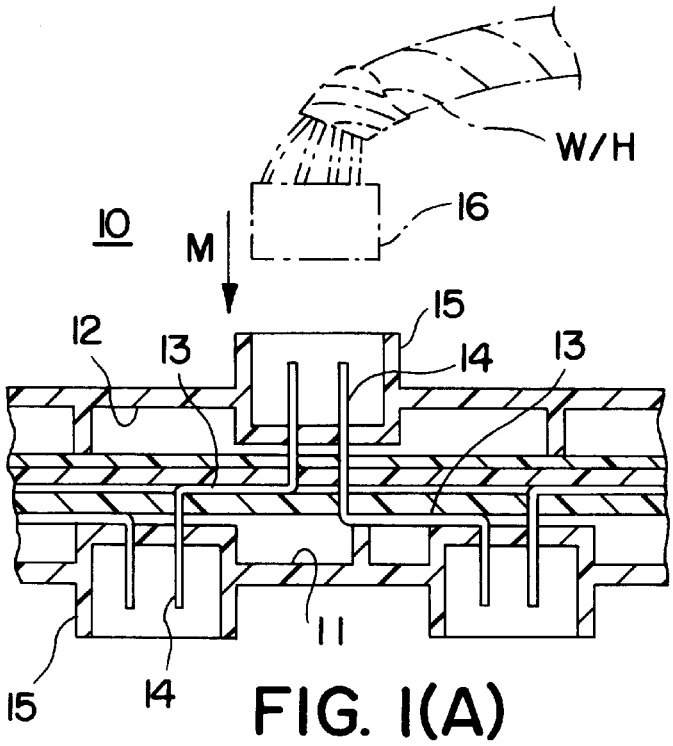
FIGS. 1(A) and 1(B) are entire and partial sections of one embodiment of the invention, respectively
Figure 4A:
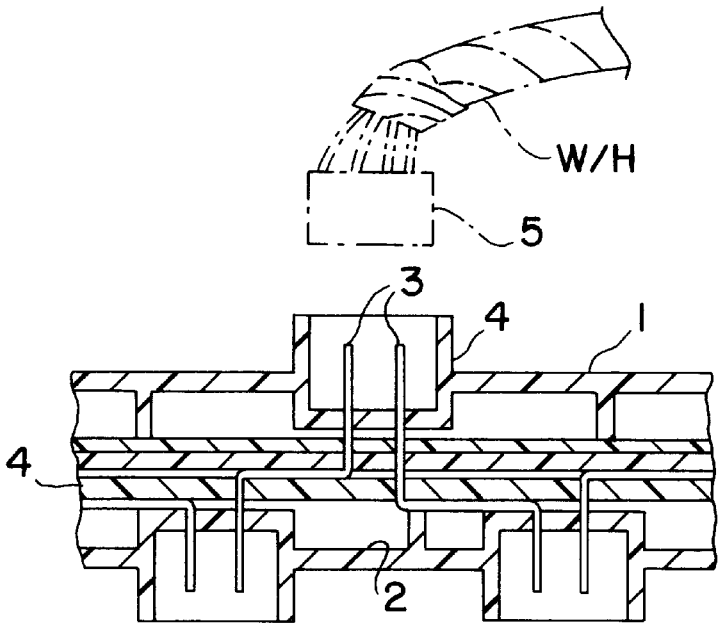
FIG.4(A) PRIOR ART
FIGS. 4(A) and 4(B) are sections of a prior art electrical connection box.
Figure 4B:
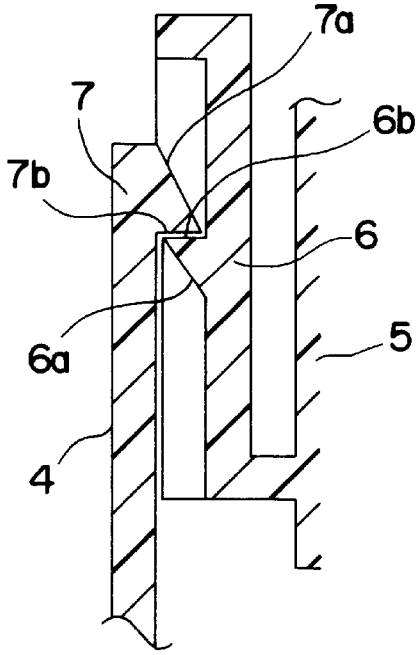
FIG.4(B) PRIOR ART

A junction box in accordance with the subject invention is illustrated in FIG. 1(A) and is identified by the numeral 10. According to this embodiment the junction box 10 is, as a whole, similar to the prior art junction box shown in FIG. 4(A). Specifically, busbars 13 are accommodated in a casing comprised of upper and lower casings 11, 12. Tabs 14 are formed at the busbars 13 and are caused to project substantially into a receptacle 15 formed on the housing, preferably the upper casing 11. A connector 16 is connected with an end of a wiring harness W/H which is fitted or fittable into the receptacle 15 in a direction of mating M to electrically connect the busbars 13 and wires W of the wiring harness W/H.

The upper and lower casings 11, 12 are made of PPGT and accordingly have a sufficient strength, but high brittleness. On the other hand, the connector 16 is made of PBT.

Figure 1B:
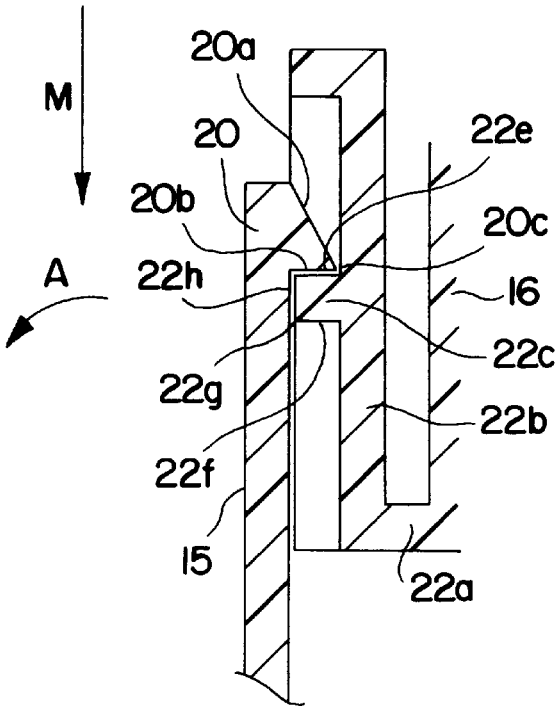

A lock claw 20 projects in the middle of the upper end of the inner surface of the substantially rectangular receptacle 15 formed on the upper casing 11. The lock claw 20 has a slanted surface 20*a* aligned at an acute angle to the direction of mating M. The lock claw 20 also includes a locking surface 20*b* which is adjacent the slanted surface 20*a* but which is aligned orthogonal to the direction of mating M. In FIG. 1(B), the locking surface 20*a* is horizontal and is provided below the slanted surface 20*a*.

Figure 2A:
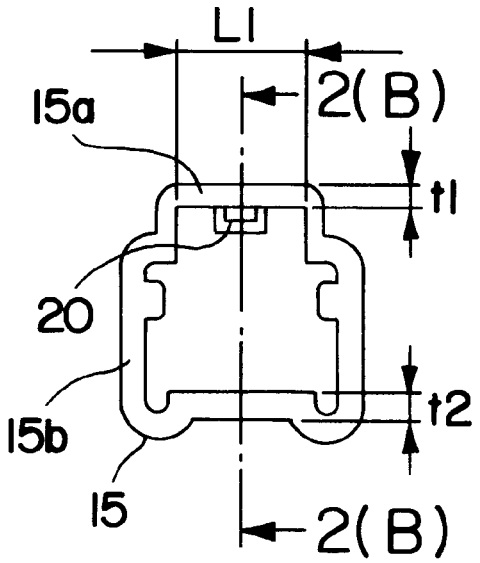
FIG. 2(A) is an enlarged plan view of an essential portion of FIG. 1(A)
Figure 2B:
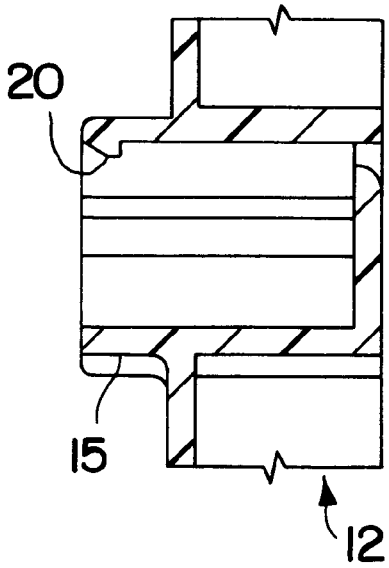
FIG. 2(B) is a section along B—B of FIG. 2(A).

The receptacle 15 has a side wall 15*a* where the lock claw 20 projects. The side wall 15*a* has a thickness t1 which, as shown in FIG. 2(A) is smaller than thickness t2 of the other three side walls 15*b*. In this embodiment, t1=1.2 mm and t2=1.5 mm.

Figure 3:
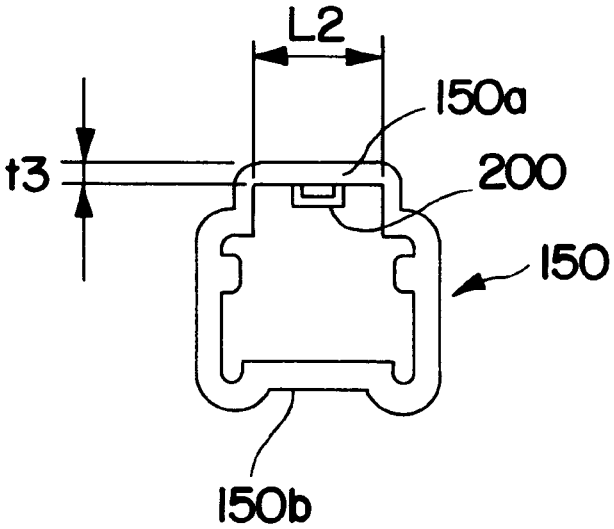
FIG. 3 PRIOR ART
FIG. 3 is a plan view of a prior art receptacle for the comparison with the construction of FIG. 2(A).

In the case of a receptacle having the same shape as the prior art shown in FIG. 3, length L2 of a side wall 150*a* where a lock claw 200 is provided is 6 mm. In this embodiment, as shown in FIG. 2(A), length L1 of the side wall 15*a* is 7.6 mm which is longer than the corresponding side of the prior art. Thickness t3 (t3=1.5 mm) of the side wall 150*a* of the receptacle 150 is same as the other side walls 150*b*.

As described above, in this embodiment, the side wall 15*a* of the receptacle 15 where the lock claw 20 is provided is made thinner (1.2 mm instead of 1.5 mm) and longer (7.6 mm instead of 6 mm) than the other side walls 15*b*. By doing so, the side wall 15*a* is made easily deformable being made longer and by being thinned.

Figure 1C:
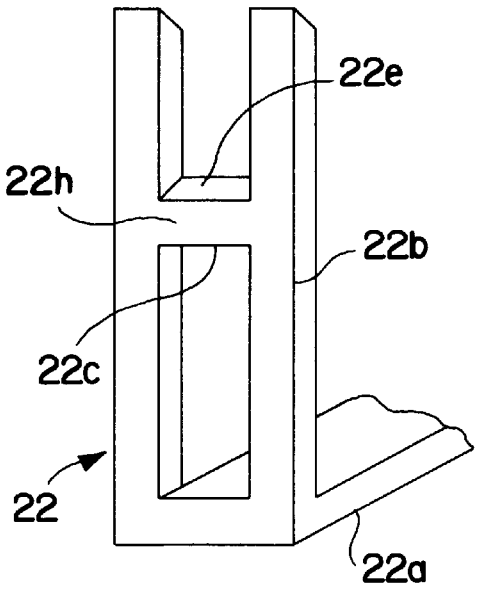
FIG. 1(C) is a perspective view of a locking portion of a connector.

On the other hand, the connector 16 to be fitted into the receptacle 15 and locked by the lock claw 20 has a locking portion 22 projecting from an end portion, preferably a bottom portion, of an outer surface thereof as shown in FIG. 1(C). The locking portion 22 includes a portion 22*a* projecting transverse to the mating direction M from an outer surface 16a of the connector 16 and a substantially H-shaped frame portion 22*b* projecting away from the leading end of the portion substantially in the mating direction M. The H-shaped frame portion 22*a* includes a transverse locking beam 22*c*. Upper and lower surfaces 22*e* and 22*f* of the locking beam 22*c* are aligned transverse to the mating direction M for locking with the locking surface 20*b* of the lock claw 20. The upper and lower surfaces 22*e* and 22*f* are preferably substantially parallel with respect to each other.

When the connector 16 is inserted and fitted into the receptacle 15 from above, an edge 22*g* at the leading end of the lower surface 22*f* of the locking beam 22*c* of the locking portion 22 is first brought substantially into contact with the slanted surface 20*a* of the lock claw 20 of the receptacle 15.

By this contact, the locking beam 22*c* of the locking portion 22 is deformed in an arrow direction A away from the lock claw 20 and the lock claw 20 is slightly deformed together with the side wall 15*a* in a direction opposite from the arrow direction. If the connector 16 is further inserted while the locking beam 22*c* and the lock claw 20 are deformed, a leading end surface 22*h* of the locking beam 22*c* is lowered while sliding in contact with a bottom end edge 20*c* of the slanted surface 20*a*. When the leading end surface 22*h* leaves the bottom end edge 20*c*, the upper surface 22*e* of the locking beam 22*c* is fitted so as to be substantially in contact with the locking surface 20*b* of the lock claw 20. At this time, the lock claw 20 and the locking portion 22 are restored to their original shapes at once, an operator can easily confirm the completion of the locking.

As is clear from the above description, according to the invention, the lock claw provided on the receptacle of the casing is made easily deformable. Accordingly, an inertial locking construction which allows an operator to easily confirm the completion of the locking can be adopted and the electrical connection box can be assembled with an improved operability.

Further, since the lock claw is made easily deformable as described above, a load is not concentrated on the lock claw despite a high brittleness due to the manufacture from PPGT. Thus, an occurrence where the lock claw is cracked or damaged can be prevented.

Furthermore, the inertial locking construction can be adopted as a locking construction provided on the connector.

What is claimed is:

1. A connector locking construction for locking a connector with an electrical connection box of an automotive vehicle, the electrical connection box having a housing made of a material having a brittleness higher than that of polybutylene (PBT) and having a plurality of tab terminals projecting from the housing, comprising:

a connector connected with an end of at least one wire and being mateable with the tab terminals of the electrical connection box by moving the connector alone a mating direction, the connector having a plurality of outer surfaces and at least one locking beam provided on one said outer surface of the connector, the locking beam having a locking surface facing away from the mating direction, and the electrical connection box being formed with a plurality of side walls defining a receptacle configured for slideably receiving the outer surfaces of the connector, the side walls of the receptacle having a selected thickness, the receptacle further having a claw support wall with a lock claw formed thereon at a location for engaging the locking surface of the locking beam when the connector is inserted in the mating direction into the receptacle, the claw support wall having a thickness, wherein the thickness of the claw support wall of the receptacle is smaller than the thickness of the side walls, and wherein the claw support wall defines a length sufficiently long to facilitate deflection of the claw support wall and to substantially prevent cracking of the locking portion.

2. A connector locking construction according to claim 1, wherein the lock claw has a slanted surface and a locking surface located substantially adjacent the slanted surface and substantially orthogonal to the mating direction of the connector with the receptacle.

3. A connector locking construction according to claim 1, wherein the locking beam has a lower surface facing away from the locking surface, the locking and lower surfaces being substantially orthogonal to the direction of mating.

4. A connector locking construction according to claim 1, wherein the length of the claw support wall is at least 7 mm.

5. A connector locking construction according to claim 4, wherein the thickness of the claw support wall is substantially 1.2 mm.

6. A connector locking construction according to claim 5, wherein the side walls of the receptacle have thicknesses of at least 1.5 mm.

7. A connector locking construction according to claim 4, wherein the thickness of the claw support wall is approximately 80% the thickness of the side walls of the receptacle.

* * * * *